US011335496B2

(12) United States Patent
Kang et al.

(10) Patent No.: US 11,335,496 B2
(45) Date of Patent: May 17, 2022

(54) COIL COMPONENT

(71) Applicant: SAMSUNG ELECTRO-MECHANICS CO., LTD., Suwon-si (KR)

(72) Inventors: Byung Soo Kang, Suwon-si (KR); Tai Yon Cho, Suwon-si (KR); Yoon Mi Cha, Suwon-si (KR); Ju Hwan Yang, Suwon-si (KR); Jeong Suong Yang, Suwon-si (KR); No Il Park, Suwon-si (KR); Byeong Cheol Moon, Suwon-si (KR); Tae Jun Choi, Suwon-si (KR); Seung Mo Lim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 311 days.

(21) Appl. No.: 16/294,575

(22) Filed: Mar. 6, 2019

(65) Prior Publication Data

US 2020/0020477 A1 Jan. 16, 2020

(30) Foreign Application Priority Data

Jul. 10, 2018 (KR) ..... 10-2018-0080217

(51) Int. Cl.
*H01F 27/29* (2006.01)
*H01F 27/28* (2006.01)

(52) U.S. Cl.
CPC ..... *H01F 27/288* (2013.01); *H01F 27/2804* (2013.01); *H01F 27/29* (2013.01)

(58) Field of Classification Search
CPC .... H01F 27/288; H01F 27/2804; H01F 27/29; H01F 27/292; H01F 2017/008;
(Continued)

(56) References Cited

U.S. PATENT DOCUMENTS 5,561,265 A * 10/1996 Livshits ..... H01L 23/08 174/386
10,121,587 B2 11/2018 Yamada
(Continued)

FOREIGN PATENT DOCUMENTS

CN 104465090 A 3/2015
CN 105845422 A 8/2016
(Continued)

OTHER PUBLICATIONS

Office Action issued in corresponding Korean Application No. 10-2018-0080217 dated Aug. 16, 2019, with English translation.
(Continued)

*Primary Examiner* — Mang Tin Bik Lian
(74) *Attorney, Agent, or Firm* — Morgan, Lewis & Bockius LLP

(57) ABSTRACT

A coil component includes a body having a bottom surface and a top surface opposing each other in one direction, and a plurality of walls each connecting the bottom surface to the top surface of the body; recesses respectively formed in both front and rear surfaces of the body opposing each other among the plurality of walls of the body and extending up to the bottom surface of the body; a coil portion buried in the body and including first and second lead-out portions exposed to internal walls and lower ledge surfaces of the recesses; first and second external electrodes respectively including connection portions disposed in the recesses and extended portions disposed on the bottom surface of the body, and connected to the coil portion; a shielding layer including a cap portion disposed on the top surface of the body and side wall portions respectively disposed on the plurality of walls of the body; and an insulating layer disposed between the body and the shielding layer and
(Continued)

extending onto lower ledge surfaces and internal walls of the recesses to cover the connection portions.

16 Claims, 14 Drawing Sheets

(58) Field of Classification Search
CPC ..... H01F 2017/0066; H01F 2017/048; H01F 17/0013; H01F 27/323; H01F 27/346; H01F 17/04; H01F 27/36; H01F 2017/002
See application file for complete search history.

(56) References Cited

U.S. PATENT DOCUMENTS

2013/0154780 A1* 6/2013 Yamada ..... H01F 17/043 336/175
2015/0048915 A1* 2/2015 Yoon ..... H01F 17/0013 336/192
2015/0084487 A1 3/2015 Mori et al.
2016/0035483 A1* 2/2016 Yamada ..... H01F 27/29 336/192
2016/0172103 A1 6/2016 Jeong et al.
2016/0225521 A1* 8/2016 Yamada ..... H01F 41/0246
2016/0268038 A1* 9/2016 Choi ..... H01F 27/255
2017/0110240 A1 4/2017 Masuda et al.
2017/0200682 A1* 7/2017 Lin ..... H01L 24/97
2018/0005751 A1* 1/2018 Igarashi ..... H01F 27/2823
2018/0096783 A1* 4/2018 Fukuda ..... H01F 27/346
2018/0166211 A1* 6/2018 Takatsuji ..... H02M 3/156

FOREIGN PATENT DOCUMENTS

CN 108183017 A 6/2018
JP 2005-310863 A 11/2005
JP 2012-60013 A 3/2012
JP 2017-76796 A 4/2017
JP 2018-98270 A 6/2018
KR 10-1998-042442 A 8/1998
KR 10-2005-0029927 A 3/2005
KR 10-2015-0019730 A 2/2015
KR 10-1548862 B1 8/2015
KR 10-2016-0071958 A 6/2016

OTHER PUBLICATIONS

Chinese Office Action dated Jan. 4, 2022 , issued in corresponding Chinese Patent Application No. 201910495374.8.

* cited by examiner

COIL COMPONENT

CROSS-REFERENCE TO RELATED APPLICATION(S)

This application claims benefit of priority to Korean Patent Application No. 10-2018-0080217 filed on Jul. 10, 2018 in the Korean Intellectual Property Office, the disclosure of which is incorporated herein by reference in its entirety.

1. TECHNICAL FIELD

The present disclosure relates to a coil component.

2. BACKGROUND

An inductor, a coil component, is a representative passive electronic component used together with a resistor and a capacitor in electronic devices.

As electronic devices are designed to have higher performance and to be reduced in size, electronic components used in electronic devices have been increased in number and reduced in size.

Accordingly, there has been increasing demand for removing a factor causing noise such as electromagnetic interference (EMI) in electronic components.

A currently used EMI shielding technique is, after mounting electronic components on a substrate, to envelop the electronic components and the substrate with a shielding can.

SUMMARY

An aspect of the present disclosure is to provide a coil component capable of reducing a magnetic flux leakage.

Another aspect of the present disclosure is to provide a coil component having a reduced size and thickness while reducing magnetic flux leakage.

According to an aspect of the present disclosure, a coil component includes a body having a bottom surface and the a top surface opposing each other in one direction, and a plurality of walls each connecting the bottom surface to the top surface of the body; recesses respectively formed in both front and rear surfaces of the body opposing each other among the plurality of walls of the body and extending up to the bottom surface of the body; a coil portion buried in the body and including first and second lead-out portions exposed to internal walls and lower ledge surfaces of the recesses; first and second external electrodes respectively including connection portions disposed in the recesses and extended portions disposed on the bottom surface of the body, and connected to the coil portion; a shielding layer including a cap portion disposed on the top surface of the body and side wall portions respectively disposed on the plurality of walls of the body; and an insulating layer disposed between the body and the shielding layer and extending onto lower ledge surfaces and internal walls of the recesses to cover the connection portions.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
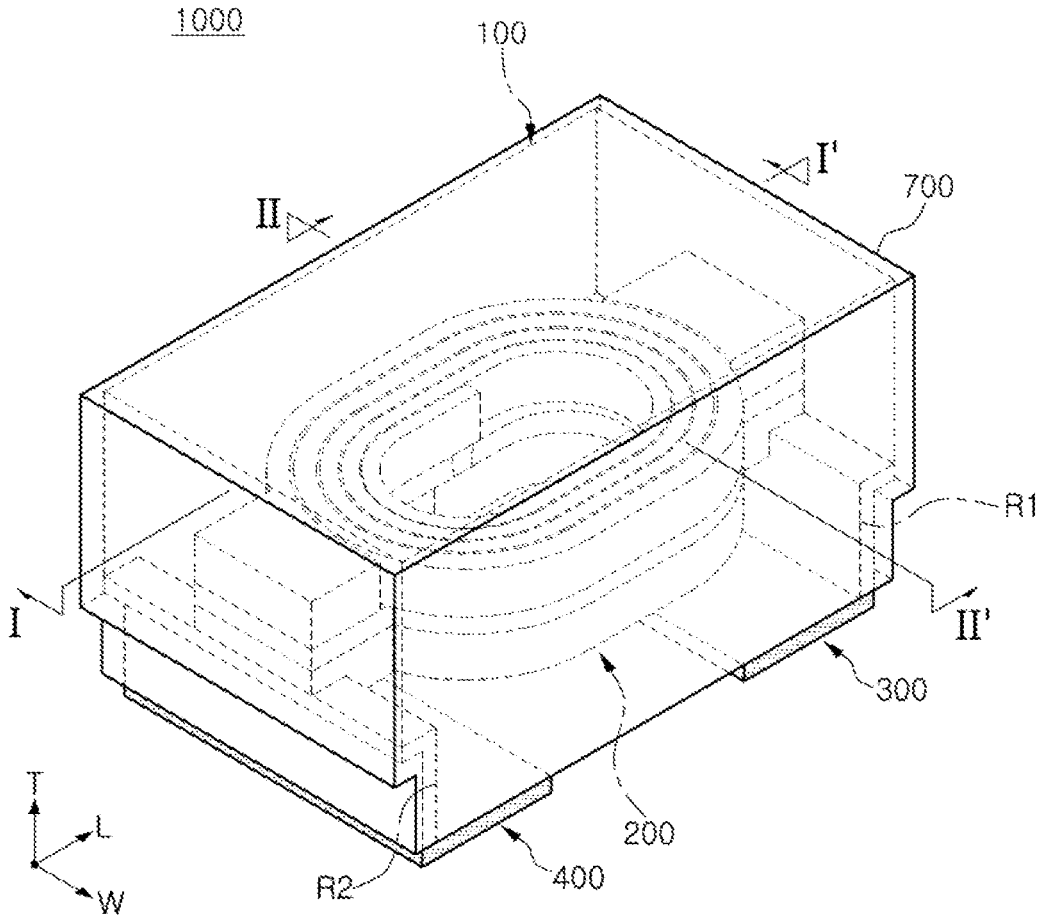
FIG. 1 is a schematic diagram illustrating a coil component according to an exemplary embodiment in the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or below an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
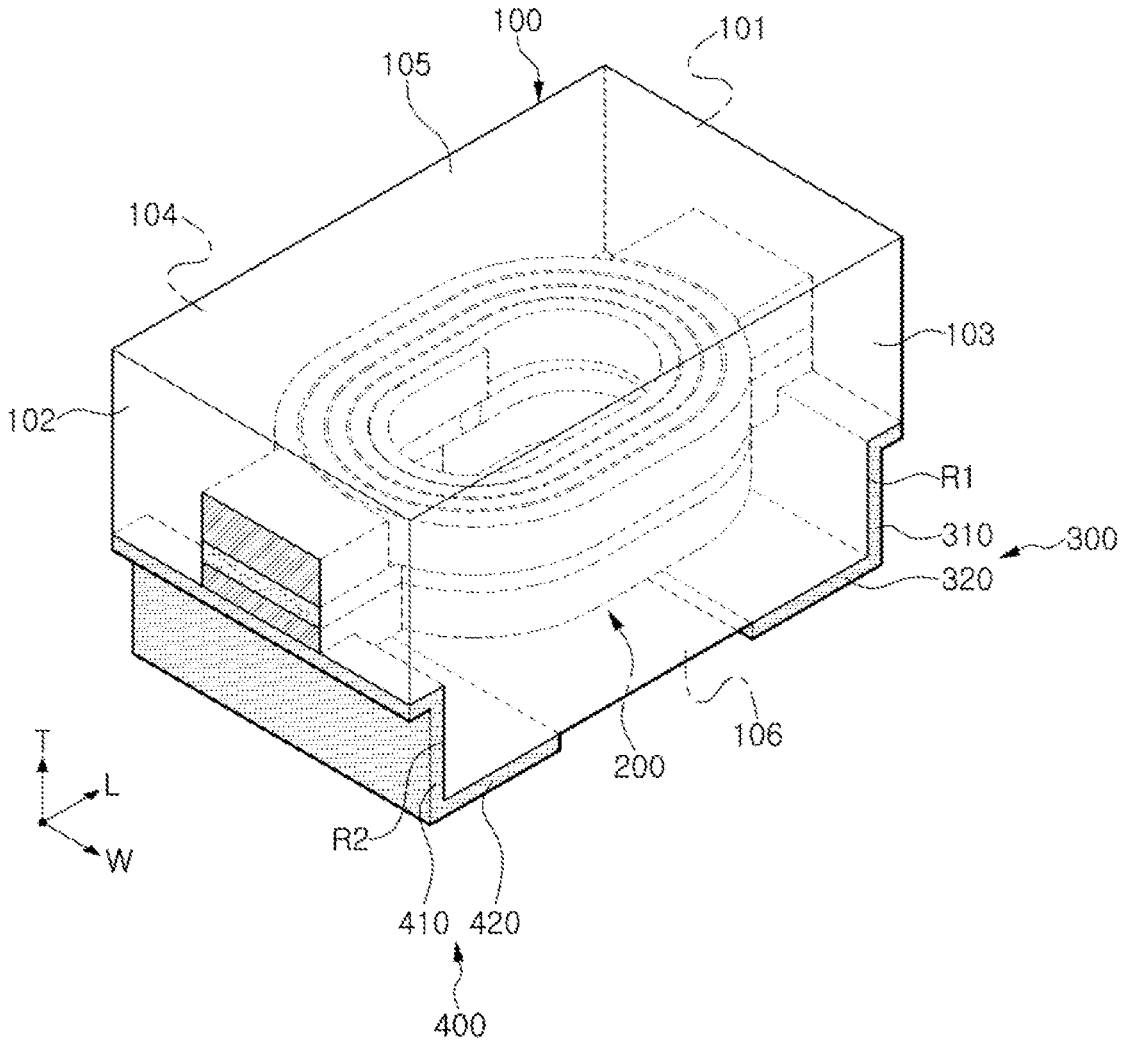
FIG. 2 is a diagram illustrating a coil component in which some of elements illustrated in FIG. 1 are omitted.
Figure 3:
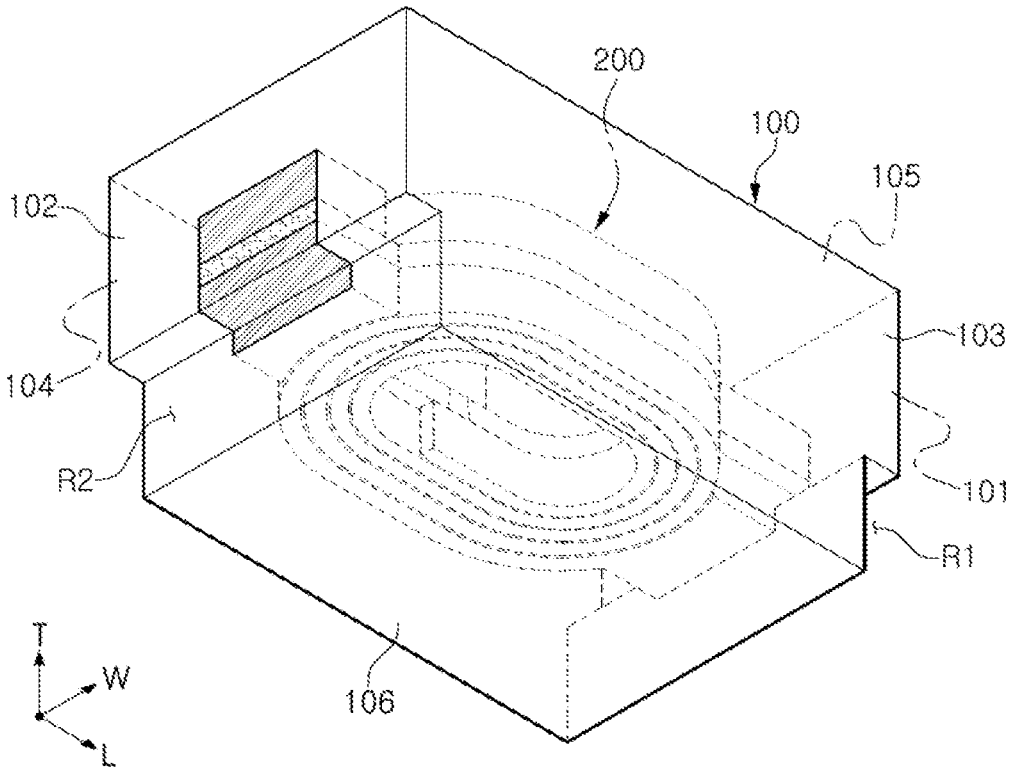
FIG. 3 is a diagram illustrating a coil component in which some of elements are omitted, viewing from a lower portion direction according to an exemplary embodiment in the present disclosure.
Figure 4:
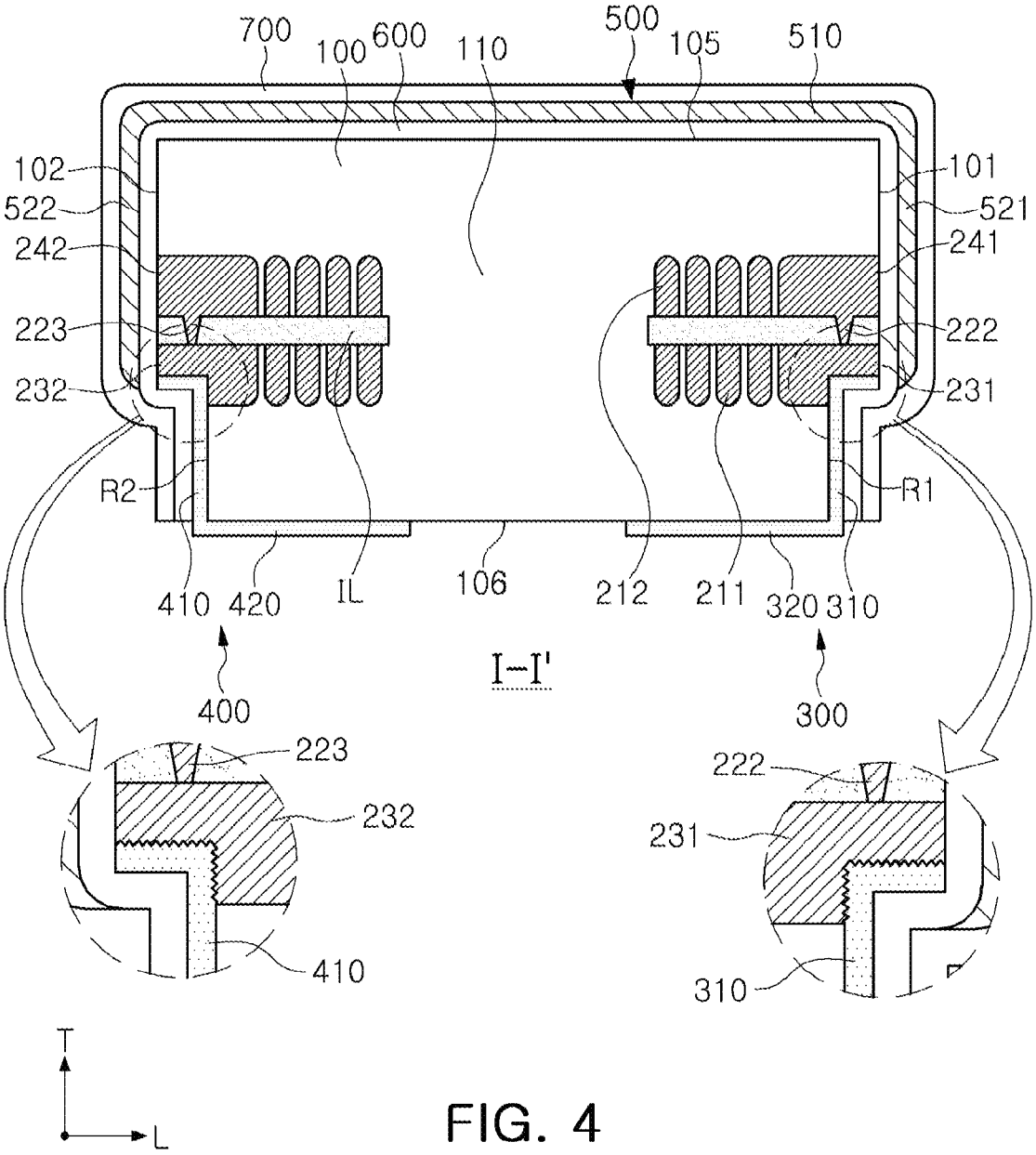
FIG. 4 is a cross-sectional diagram taken along line I-I' in FIG. 1.
Figure 5:
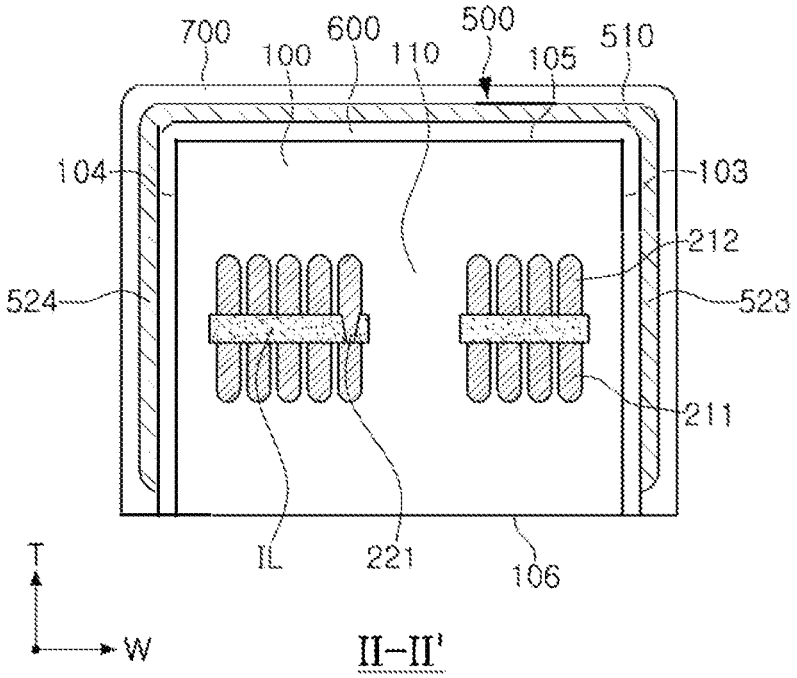
FIG. 5 is a cross-sectional diagram taken along line II-II' in FIG. 1.
Figure 6:
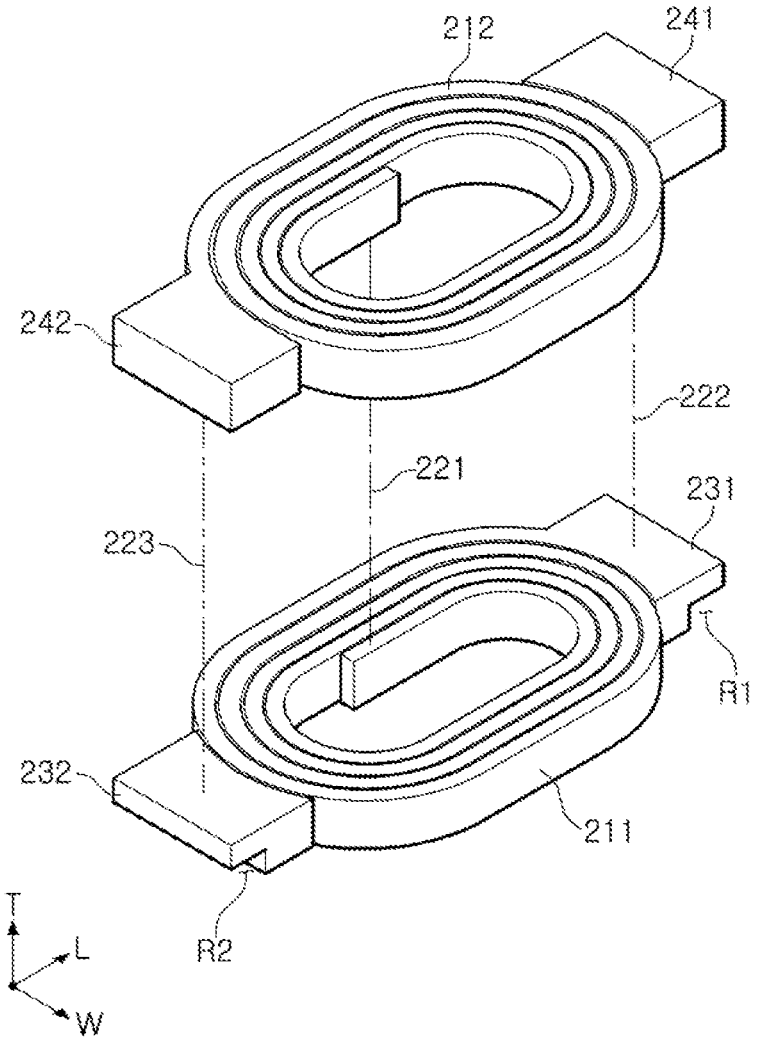
FIG. 6 is an exploded diagram illustrating a coil portion.

FIG. 1 is a schematic diagram illustrating a coil component according to an exemplary embodiment. FIG. 2 is a diagram illustrating a coil component in which some of elements illustrated in FIG. 1 are omitted, and more specifically, illustrating a coil component illustrated in FIG. 1 without an insulating layer, a shielding layer, and a cover layer. FIG. 3 is a diagram illustrating a coil component in which some of elements are omitted, viewing from a lower portion direction according to an exemplary embodiment, and more specifically, illustrating a coil component without an external electrode, an insulating layer, a shielding layer, and a cover layer. FIG. 4 is a cross-sectional diagram taken along line I-I' in FIG. 1. FIG. 5 is a cross-sectional diagram taken along line II-II' in FIG. 1. FIG. 6 is an exploded diagram illustrating a coil portion.

Referring to FIGS. 1 to 6, a coil component 1000 according to an exemplary embodiment may include a body 100, an internal insulating layer IL, recesses R1 and R2, a coil portion 200, external electrodes 300 and 400, a shielding layer 500, and an insulating layer 600, and may further include a cover layer.

The body 100 may form an exterior of the coil component 1000, and may bury the coil portion 200.

The body 100 may have a hexahedral shape.

Referring to FIG. 1 and FIG. 2, the body 100 may include a first surface 101 and a second surface 102 opposing each other in a length direction L, a third surface 103 and a fourth surface 104 opposing each other in a width direction W, a fifth surface 105 (a top surface) and a sixth surface 106 (a bottom surface) opposing each other in a thickness direction T. The first to fourth surfaces 101, 102, 103, and 104 of the body 100 may be walls of the body 100 connecting the fifth surface 105 and the sixth surface 106 of the body 100. In the description below, "both front and rear surfaces of the body" may refer to the first surface 101 and the second surface 102, and "both side surfaces of the body" may refer to the third surface 103 and the fourth surface 104 of the body.

As an example, the body 100 may be configured such that the coil component 1000 on which the external electrodes 300 and 400 are formed may have a length of 2.0 mm, a width of 1.2 mm, and a thickness of 0.65 mm, but an exemplary embodiment thereof is not limited thereto. In one embodiment, the length of the coil component 1000 is 1.9 mm, 1.8 mm, 1.7 mm, 1.6 mm, or 1.5 mm. In one embodiment, the width of the coil component 1000 is 1.1 mm, 1.0 mm, 0.9 mm, 0.8mm, 0.7 mm, or 0.6 mm. In one embodiment, the thickness of the coil component is 0.60 mm, 0.55 mm, 0.50 mm, 0.45 mm, 0.40 mm, 0.35 mm, or 0.30 mm.

The body 100 may include a magnetic material and a resin material. For example, the body 100 may be formed by layering one or more magnetic composite sheets including a resin material and a magnetic material dispersed in the resin material. Alternatively, the body 100 may have a structure different from the structure in which a magnetic material is dispersed in a resin material. For example, the body 100 may be formed of a magnetic material such as a ferrite.

The magnetic material may be a ferrite or a magnetic metal powder.

The ferrite powder may include, for example, one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as an yttrium (Y) ferrite, and a lithium (Li) ferrite.

The magnetic metal powder may include one or more materials selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an example of the magnetic metal powder is not limited thereto.

The ferrite and the magnetic metal powder may have an average diameter of 0.1 μm to 30 μm, but an example of the average diameter is not limited thereto. In one embodiment, the average diameter of the ferrite or the magnetic metal powder is 0.5 μm, 1 μm, 5 μm, 10 μm, 15 μm, 20 μm, or 25 μm.

The body 100 may include two or more types of magnetic materials dispersed in a resin material. The notion that types of the magnetic materials are different may indicate that one of an average diameter, a composition, crystallinity, and a form of one of magnetic materials is different from those of the other magnetic material.

The resin material may include one of an epoxy resin, a polyimide, a liquid crystal polymer, or mixture thereof, but an example of the resin material is not limited thereto.

The body 100 may include a core 110 penetrating through a coil portion 200, which will be described later. The core 110 maybe formed by filling a through hole of the coil portion 200 with magnetic composite sheets, but an exemplary embodiment thereof is not limited thereto.

The first and second recesses R1 and R2 may respectively be formed on the first surface 101 and the second surface 102 and may extend up to the sixth surface 106 of the body 100. In other words, the first recess R1 may be formed on the first surface 101 of the body 100 and may extend up to the sixth surface 106 of the body 100, and the second recess R2 may be formed on the second surface 102 of the body 100 and may extend up to the sixth surface 106 of the body 100. The first and second recesses R1 and R2 may not extend to the fifth surface 105 of the body 100. In other words, the recesses R1 and R2 may not penetrate through the body 100 in a thickness direction of the body 100.

In the exemplary embodiment, the first and second recesses R1 and R2 may respectively extend to the third surface 103 and the fourth surface 104 of the body 100 in a width direction of the body 100. The recesses R1 and R2 may be slits formed in an overall width direction portion of the body 100. The first and second recesses R1 and R2 may be formed by pre-dicing a coil bar, in a form before individual coil components are created by dicing the coil bar, along a boundary line corresponding to a width direction of each coil component among boundary lines dividing the coil components. A depth of the pre-dicing may be adjusted such that portions of lead-out portions 231 and 232, which are described below, maybe removed along a portion of the body 100. In other words, the depth of the pre-dicing may be adjusted such that the lead-out portions 231 and 232 may be exposed to lower ledge surfaces and internal walls of the first and second recesses R1 and R2.

The internal walls of the first and second recesses R1 and R2 and the lower ledge surfaces of the first and second recesses R1 and R2 may also form surfaces of the body 100. In the exemplary embodiment, however, the internal walls and the lower ledge surfaces of the first and second recesses R1 and R2 may be distinct from the surfaces of the body 100.

The first and second recesses R1 and R2 may include the internal wall and the lower ledge surface, respectively. The internal walls of the first and second recesses R1 and R2 may be a rectangular shape having a long side in the width direction W and a shorter side in the thickness direction T. The width of the long side of the internal walls of the first and second recesses R1 and R2 may be the same as the width of the body 100, respectively. In another embodiment, the long side of the internal walls of the first and second recesses R1 and R2 may have a shorter width than the width of the body 100. In one embodiment, the width of the long side of the internal walls of the recesses of the R1 and R2 may be 1.2 mm, 1.1 mm, 1.0 mm, 0.9 mm, 0.8 mm, 0.7 mm, or 0.6 mm. The width of the long side of the internal walls of the first and second recesses R1 and R2 may be the same as or different from each other. The height of the short side of the internal walls of the first and second recesses R1 and R2 may be shorter than the height of the body 100. In one embodiment, the height of the short side of the internal walls of the first and second recesses may be 0.30 mm, 0.2 mm, 0.1 mm, 0.05 mm.

The lower ledge surface of the first and second recesses R1 and R2 may be a rectangular shape having a long side in the width direction W and a shorter side in the length direction L. The width of the long side of the lower ledge surface of the first and second recesses R1 and R2 may be the same as the width of the body 100, respectively. In another embodiment, the long side of the lower ledge surface of the first and second recesses R1 and R2 may have a shorter width than the width of the body 100. In one embodiment, the width of the long side of the lower ledge surface of the recesses of the R1 and R2 may be 1.2 mm, 1.1 mm, 1.0 mm, 0.9 mm, 0.8 mm, 0.7 mm, or 0.6 mm. The width of the long side of the lower ledge surface of the first and second recesses R1 and R2 may be the same as or different from each other. The length of the short side of the lower ledge surface of the first and second recesses R1 and R2 may be shorter than the length of the body 100. In one embodiment, the length of the short side of the lower ledge surface of the first and second recesses may be 0.5 mm, 0.4 mm, 0.3 mm, 0.2 mm, or 0.1 mm. The length of the short side of the lower ledge surface of the first and second recesses R1 and R2 may be the same as or different from each other.

The internal insulating layer IL may be buried in the body 100. The internal insulating layer IL may support the coil portion 200.

The internal insulating layer IL may be formed of an insulating material including a thermosetting insulating resin such as an epoxy resin, a thermoplastic insulating resin such as a polyimide, or a photosensitive insulating resin, or may be formed of an insulating material in which a reinforcing material such as a glass fiber or an inorganic filler is impregnated with such an insulating resin. For example, the internal insulating layer IL may be formed of an insulating material such as prepreg, ajinomoto build-up film (ABF), FR-4, a bismaleimide triazine (BT) resin, a photoimageable dielectric (PID), and the like, but an example of the material of the internal insulating layer is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer IL is formed of an insulating material including a reinforcing material, the internal insulating layer IL may provide improved stiffness. When the internal insulating layer IL is formed of an insulating material which does not include a glass fiber, the internal insulating layer IL may be desirable to reducing an overall thickness of the coil portion 200. When the internal insulating layer IL is formed of an insulating material including a photosensitive insulating resin, the number of processes for forming the coil portion 200 may be reduced such that manufacturing costs maybe reduced, and a fine via maybe formed.

The coil portion 200 may be buried in the body 100, and may embody properties of the coil component. For example, when the coil component 1000 is used as a power inductor, the coil portion 200 may store electric fields as magnetic fields such that an output voltage may be maintained, thereby stabilizing power of an electronic device.

The coil portion 200 may include first and second coil patterns 211 and 212, first and second lead-out portions 231 and 232, first and second auxiliary lead-out portions 241, 242, and first to third vias 221, 222, and 223.

Referring to FIGS. 4 and 5, the first coil pattern 211, the first lead-out portion 231, and the second lead-out portion 232 may be disposed on a lower ledge surface of the internal insulating layer IL opposing the sixth surface 106 of the body 100, and the second coil pattern 212, the first auxiliary lead-out portion 241, and the second auxiliary lead-out portion 242 may be disposed on an upper surface of the internal insulating layer IL opposing a lower ledge surface of the internal insulating layer IL.

Referring to FIGS. 4 to 6, the first coil pattern 211 may be in contact with and connected to the first lead-out portion 231, and the first coil pattern 211 and the first lead-out portion 231 may be spaced apart from the second lead-out portion 232, on a lower ledge surface of the internal insulating layer IL. Also, the second coil pattern 212 may be in contact with and connected to the second auxiliary lead-out portion 242, and the second coil pattern 212 and the second auxiliary lead-out portion 242 may be spaced apart from the first auxiliary lead-out portion 241, on an upper surface of the internal insulating layer IL. Further, a first via 221 may penetrate through the internal insulating layer IL and may be in contact with the first coil pattern 211 and the second coil pattern 212, and a second via 222 may penetrate through the internal insulating layer IL and may be in contact with the first lead-out portion 231 and the first auxiliary lead-out portion 241. A third via 233 may penetrate through the internal insulating layer IL and may be in contact with the second lead-out portion 232 and the second auxiliary lead-out portion 242. Accordingly, the coil portion 200 may function as a single coil.

The first coil pattern 211 and the second coil pattern 212 each may have a planar spiral shape forming at least one turn centering on the core 110 as an axis. For example, the first coil pattern 211 may form at least one turn on a lower ledge surface of the internal insulating layer IL centering on the core 110 as an axis.

The first and second recesses R1 and R2 may respectively extend to the first lead-out portion 231 and the second lead-out portion 232, respectively. Accordingly, the first lead-out portion 231 may be exposed to a lower ledge surface and an internal wall of the first recess R1, and the second lead-out portion 232 may be exposed to a lower ledge surface and an internal wall of the second recess R2. External electrodes 300 and 400, which will be described below, may be formed on the lead-out portions 231 and 232 exposed to lower ledge surfaces and internal walls of the recesses R1 and R2, and the coil portion 200 may be connected to the external electrodes 300 and 400.

One surfaces of the lead-out portions 231 and 232 exposed to the internal walls and lower ledge surfaces of the recesses R1 and R2 may have surface roughness higher than surface roughness of the other surfaces of the lead-out portions 231 and 232. For example, when the recesses R1 and R2 are formed on the lead-out portions 231 and 232 and on the body 100 after forming the lead-out portions 231 and 232 by an electroplating process, portions of the lead-out portions 231 and 232 may be removed during a recess forming process. Accordingly, one surfaces of the lead-out portions 231 and 232 exposed to internal walls and lower ledge surfaces of the recesses R1 and R2 may have higher surface roughness than surface roughness of the other surfaces of the lead-out portions 231 and 232 by a grinding process of the dicing tip. The external electrodes 300 and 400 may be formed as thin films such that cohesion force between the external electrodes 300 and 400 and the body 100 may be weak. However, as the external electrodes 300 and 400 are in contact with and connected to one surfaces of the lead-out portions 231 and 232 having relatively high surfaces roughness, cohesion force between the external electrodes 300 and 400 and the lead-out portions 231 and 232 may improve.

In the exemplary embodiment, the lead-out portions 231 and 232 and the auxiliary lead-out portions 241 and 242 may respectively be exposed to both front and rear surfaces 101 and 102 of the body 100. In other words, the first lead-out portion 231 may be exposed to the first surface 101 of the body 100, and the second lead-out portion 232 maybe exposed to the second surface 102 of the body 100. Also, the first auxiliary lead-out portion 241 may be exposed to the first surface 101 of the body 100, and the second auxiliary lead-out portion 242 may be exposed to the second surface 102 of the body 100. Accordingly, the first lead-out portion 231 may consecutively be exposed to an internal wall of the first recess R1, a lower ledge surface of the first recess R1, and the first surface 101 of the body 100, and the second lead-out portion 232 may consecutively be exposed to an internal wall of the second recess R2, a lower ledge surface of the second recess R2, and the second surface 102 of the body 100.

At least one of the coil patterns 211 and 212, the vias 221, 222, and 223, the lead-out portions 231 and 232, and the auxiliary lead-out portions 241 and 242 may include at least one or more conductive layers.

For example, when the second coil pattern 212, the auxiliary lead-out portions 241 and 242, and the vias 221, 222, and 223 are formed on the other surface of the internal insulating layer IL through a plating process, the second coil pattern 212, the auxiliary lead-out portions 241 and 242, and the vias 221, 222, and 223 each may include a seed layer such as an electroless plating layer, and an electroplating layer. The electroless plating layer may have a single-layer structure, or may have a multiple-layer structure. The electroplating layer having a multiple-layer structure may have a conformal film structure in which one of the electroplating layers is covered by the other electroplating layer, or may have a form in which one of the electroplating layers is disposed on one surface of the other plating layers. The seed layer of the second coil pattern 212, the seed layers of the auxiliary lead-out portions 241 and 242, and the seed layers of the vias 221, 222, and 223 maybe integrated with one another such that no boundary may be formed therebeteween, but an exemplary embodiment thereof is not limited thereto.

As another example, referring to FIGS. 1 to 5, when the first coil pattern 211 and the lead-out portions 231 and 232 disposed on a lower ledge portion of the internal insulating layer IL, and the second coil pattern 212 and the auxiliary lead-out portions 241 and 242 disposed on an upper portion of the internal insulating layer IL are formed independently from one another, and the coil portion 200 is formed by layering the first coil pattern 211, the lead-out portions 231 and 232, the second coil pattern 212, and the auxiliary lead-out portions 241 and 242, the vias 221, 222, and 223 may include a metal layer having a high melting point, and a metal layer having a low melting point relatively lower than the melting point of the metal layer having a high melting point. The metal layer having a low melting point may be formed of a solder including lead (Pb) and/or tin (Sn). The metal layer having a low melting point may have at least a portion melted due to pressure and temperature generating during the layering process, and an inter-metallic compound layer (IMC layer) maybe formed between the metal layer having a low melting point and the second coil pattern 212, for example.

As illustrated in FIGS. 4 and 5, the coil patterns 211 and 212, the lead-out portions 231 and 232, and the auxiliary lead-out portions 241 and 242 maybe formed on and protrude from a lower ledge surface and an upper surface of the internal insulating layer IL, for example. As another example, the first coil pattern 211 and the lead-out portions 231 and 232 may be formed on and protrude from a lower ledge surface of the internal insulating layer IL, and the second coil pattern 212 and the auxiliary lead-out portions 241 and 242 maybe buried in an upper surface of the internal insulating layer IL, and upper surfaces of the second coil pattern 212 and the auxiliary lead-out portions 241 and 242 may be exposed to the upper surface of the internal insulating layer IL. In this case, a concave portion may be formed on an upper surface of the second coil pattern 212 and/or upper surfaces of the auxiliary lead-out portions 241 and 242 such that the upper surface of the internal insulating layer IL may not be coplanar with the upper surface of the second coil pattern 212 and/or the upper surfaces of the auxiliary lead-out portions 241 and 242.

The coil patterns 211 and 212, the lead-out portions 231 and 232, the auxiliary lead-out portions 241 and 242, and the vias 221, 222, and 223 each may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

Referring to FIG. 6, the first auxiliary lead-out portion 241 may be irrelevant to electrical connections among the other elements of the coil portion 200, and thus, the first auxiliary lead-out portion 241 may be omitted in the exemplary embodiment. However, it may be desirable to form the first auxiliary lead-out portion 241 to omit a process of distinguishing the fifth surface 105 and the sixth surface 106 of the body 100 from each other.

The first and second external electrodes 300 and 400 may respectively include first and second connection portions 310 and 410 disposed on the recesses R1 and R2 and first and second extended portions 320 and 420 disposed on the sixth surface 106 of the body 100, and may be connected to the coil portion 200. The first and second external electrodes 300 and 400 may be spaced apart from each other on the sixth surface 106 of the body 100. For example, the first external electrode 300 may include the first connection portion 310 disposed on an internal wall and a lower ledge surface of the first recess R1 to be connected to the first lead-out portion 231, and a first extended portion 320 expending from the first connection portion 310 and disposed on the sixth surface 106 of the body 100. The second external electrode 400 may include a second connection portion 410 disposed on an internal wall and a lower ledge surface of the second recess R2 to be connected to the second lead-out portion 232, and a second extended portion 420 extending from the second connection portion 410 and disposed on the sixth surface 106 of the body 100.

The first and second external electrodes 300 and 400 maybe formed along lower ledge surfaces of the recesses R1 and R2, internal walls of the recesses R1 and R2, and the sixth surface 106 of the body 100. In other words, the first and second external electrodes 300 and 400 each maybe formed as a conformal film. The first and second external electrodes 300 and 400 may be integrated with each other on lower ledge surfaces of the recesses R1 and R2, internal walls of the recesses R1 and R2, and the sixth surface 106 of the body 100. In other words, the connection portions 310 and 410 and the extended portions 320 and 420 may be formed together through the same process and may be integrated with each other. The first and second external electrodes 300 and 400 maybe formed through a thin film process such as a sputtering process.

The first and second external electrodes 300 and 400 may be formed of a conductive material such as copper (Cu), aluminum (Al), silver (Ag), tin (Sn), gold (Au), nickel (Ni), lead (Pb), chromium (Cr), titanium (Ti), or alloys thereof, but an example of the material is not limited thereto. The first and second external electrodes 300 and 400 may be formed of a single layer or multiple layers.

The shielding layer 500 may include a cap portion 510 disposed on the fifth surface 105 of the body 100, and side wall portions 521, 522, 523, and 524 respectively disposed on the first to fourth surfaces 101, 102, 103, and 104 of the body 100. The shielding layer 500 maybe disposed on a surface of the body 100 other than the sixth surface 106 of the body 100, and may reduce magnetic flux leakage of the coil component 1000.

The first and second side wall portions 521 and 522 formed on the first and second surfaces 101 and 102 of the body 100 may not extend to lower ledge surfaces or internal walls of the recesses R1 and R2.

The cap portion 510 and the side wall portions 521, 522, 523, and 524 may be integrated with each other. In other words, the cap portion 510 and the side wall portions 521, 522, 523, and 524 may be formed through the same process such that boundaries between the cap portion 510 and the side wall portions 521, 522, 523, and 524 may not be formed. For example, the cap portion 510 and the side wall portions 521, 522, 523, and 524 may be integrated with each other by attaching a single shield sheet including an insulating film and a shield film to the first to fifth surfaces of the body 100. The insulating film of the shield sheet may correspond to an insulating layer 600, which will be described later. As another example, the cap portion 510 and the side wall portions 521, 522, 523, and 524 maybe integrated with each other by forming the shielding layer 500 on the first to fifth surfaces of the body 100 through a vapor deposition process such as a sputtering process. When the shielding layer 500 is formed through a sputtering process, the shielding layer 500 may not be formed on lower ledge surfaces and internal walls of the recesses R1 and R2 due to relatively low step coverage of a sputtering process.

The shielding layer 500 may include at least one of a conductive material and a magnetic material. For example, a conductive material may be a metal or an alloy including one or more materials selected from a group consisting of copper (Cu), aluminum (Al), iron (Fe), silicon (Si), boron (B), chromium (Cr), niobium (Nb), and nickel (Ni), or may be Fe—Si or Fe—Ni. Also, the shielding layer 500 may include one or more materials selected from a group consisting of a ferrite, a permalloy, and an amorphous ribbon.

The shielding layer 500 may include two or more separate fine structures. For example, when the cap portion 510 and the side wall portions 521, 522, 523, and 524 each are formed of amorphous ribbon sheets, respectively divided into a plurality of pieces isolated from one another, the cap portion 510 and the side wall portions 521, 522, 523, and 524 each may include a plurality of fine structures isolated from one another.

The shielding layer 500 may have a thickness of 10 nm to 100 μm. When a thickness of the shielding layer 500 is less than 10 nm, an EMI shielding effect may not be implemented, and when a thickness of the shielding layer 500 is greater than 100 μm, an overall length, width, and thickness of the coil component may increase, and it may be difficult to reduce a size of the coil component. In one embodiment, the thickness of the shielding layer 500 is 50 nm, 100 nm, 500 nm, 1 μm, or 50 μm.

The insulating layer 600 may be disposed between the body 100 and the shielding layer 500, and may extend to lower ledge surfaces and internal walls of the recesses R1 and R2 to cover the connection portions 310 and 410. The insulating layer 600 may electrically insulate the shielding layer 500 from the body 100 and the first and second external electrodes 300 and 400.

The insulating layer 600 may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photosensitive resin, a parylene, and SiOx or SiNx.

The insulating layer 600 may be formed by applying a liquid insulating resin onto the body 100, by layering an insulating film such as a dry film (DF) on the body 100, or by forming an insulating material on the surface of the body 100 and on the connection portions 310 and 410 through a vapor deposition process. As the insulating film, an Ajinomoto build-up film which does not include a photosensitive insulating resin, or a polyimide film, or the like, maybe used.

The insulating layer 600 may have a thickness of 10 nm to 100 μm. When a thickness of the insulating layer 600 is less than 10 nm, properties of a coil component such as a Q factor may reduce, and when a thickness of the insulating layer 600 is greater than 100 μm, an overall length, width, and thickness of the coil component may increase such that it may be difficult to reduce a size of the coil component. In one embodiment, the thickness of the insulating layer 600 is 50 nm, 100 nm, 500 nm, 1 μm, or 50 μm.

The cover layer 700 may be disposed on the shielding layer 500 to cover the shielding layer 500 and may be in contact with the insulating layer 600. In other words, the cover layer 700 may bury the shielding layer 500 in the cover layer 700 along with the insulating layer 600. Thus, the cover layer 700 may be disposed on the first to fifth surfaces of the body 100, and internal walls and lower ledge surfaces of the recesses R1 and R2. The cover layer 700 may cover ends of the side wall portions 521, 522, 523, and 524 such that the cover layer 700 may prevent electrical connection between the side wall portions 521, 522, 523, and 524 and the external electrodes 300 and 400. Further, the cover layer 700 may prevent the shielding layer 500 from being electrically connected to external electronic components.

The cover layer 700 may include at least one of a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and silicon oxide (SiOx) or silicon nitride (SiNx).

The cover layer 700 may be formed by layering a cover film such as a dry film (DF) on the body 100 on which the shielding layer 500 is formed. Alternatively, the cover layer 700 may be formed by forming an insulating material on the body 100 on which the shielding layer 500 is formed through a vapor deposition process such as a chemical vapor deposition (CVD) process.

The cover layer 700 may have an adhesive function. For example, when the cover layer 700 is formed by layering a cover film on the body 100, the cover layer 700 may include an adhesive material to be adhered to the shielding layer 500.

The cover layer 700 may have a thickness of 10 nm to 100 μm. When a thickness of the cover layer 700 is less than 10 nm, insulating properties may be weakened such that electrical shorts may occur, and when a thickness of the cover layer 700 is greater than 100 μm, an overall length, width, and thickness of the coil component may increase, and it may be difficult to reduce a size of the coil component. In one embodiment, the thickness of the cover layer 700 is 50 nm, 100 nm, 500 nm, 1 μm, or 50 μm.

A sum of thicknesses of the insulating layer 600, the shielding layer 500, and the cover layer 700 may be greater than 30 nm, and may be 100 μm or lower. When a sum of thicknesses of the insulating layer 600, the shielding layer 500, and the cover layer 700 is less than 30 nm, the issues such as electrical shorts, reduction of properties of a coil component such as a Q factor, and the like, may occur, whereas, when a sum of thicknesses of the insulating layer 600, the shielding layer 500, and the cover layer 700 is greater than 100 μm, an overall length, width, and thickness of the coil component may increase, and it may be difficult to reduce a size of the coil component.

Although not illustrated, in the exemplary embodiment, the coil component may further include an insulating film formed along surfaces of the lead-out portions 231 and 232, the coil patterns 211 and 212, the internal insulating layer IL, and the auxiliary lead-out portions 241 and 242. The insulating film may protect the lead-out portions 231 and 232, the coil patterns 211 and 212, and the auxiliary lead-out portions 241 and 242, and may insulate the lead-out portions 231 and 232, the coil patterns 211 and 212, and the auxiliary lead-out portions 241 and 242 from the body 100, and may include a well-known insulating material such as parylene, and the like. A material included in the insulating film may not be limited to any particular material. The insulating film may be formed through a vapor deposition process, and the like, but an example of the insulating film is not limited thereto. The insulating film may be formed by layering the insulating film on both surfaces of the internal insulating layer IL.

In the exemplary embodiment, the coil component may further include an additional insulating layer distinct from the insulating layer 600, and may be attached to and formed on at least one of the first to sixth surfaces 101, 102, 103, 104, 105, and 106 of the body 100. For example, when the additional insulating layer is formed on the sixth surface 106 of the body 100, the extended portions of the external electrodes 300 and 400 may extend onto the additional insulating layer. The additional insulating layer may include a thermoplastic resin such as a polystyrene resin, a vinyl acetate resin, a polyester resin, a polyethylene resin, a polypropylene resin, a polyamide resin, a rubber resin, an acrylic resin, and the like, a thermosetting resin such as a phenolic resin, an epoxy resin, a urethane resin, a melamine resin, an alkyd resin, and the like, a photosensitive resin, a parylene, and SiOx or SiNx.

The insulating layer 600 and the cover layer 700 may be directly disposed in the coil component, and may be distinct from a molding material molding the coil component and a printed circuit board during a process of mounting the coil component on the printed circuit board. For example, the insulating layer 600 and the cover layer 700 may not be in contact with a printed circuit board, differently from a molding material. Also, the insulating layer 600 and the cover layer 700 may not be supported by or fixed to a printed circuit board, differently from a molding material. Further, differently from a molding material surrounding a connection member such as a solder ball which connects a coil component to a printed circuit substrate, the insulating layer 600 and the cover layer 700 may not surround a connection member. As the insulating layer 600 is not a molding material formed by heating an epoxy molding compound, and the like, flowing the heated epoxy molding compound onto a printed circuit board, and performing a curing process, it may not be necessary to consider a void occurring during a process of forming a molding material, or warpage of a printed circuit board caused by a difference in coefficients of thermal expansion between a molding material and a printed circuit board.

The shielding layer 500 maybe directly disposed in the coil component in the exemplary embodiment, and thus, the shielding layer 500 may be different from a shielding can, which is coupled to a printed circuit board to shield EMI, and the like, after mounting the coil component on a printed circuit board. For example, the shielding layer 500 may not be required to be connected to a ground layer of a printed circuit board, differently from a shielding can. As another example, the shielding layer 500 may not require a fixing member for fixing the shielding can to a printed circuit board.

Accordingly, the coil component 1000 according to the exemplary embodiment may effectively shield magnetic flux leakage occurring in the coil component by directly forming the shielding layer 500 in the coil component. In other words, as electronic devices are reduced in size and have higher performances, the number of electronic components included in an electronic device and a distance between adjacent electronic components have been reduced recently. In the exemplary embodiment, each coil component may be shielded such that magnetic flux leakage occurring in coil components may be shielded effectively, thereby reducing sizes of electronic components and implementing high performance. Further, in the coil component 1000 in the exemplary embodiment, the amount of an effective magnetic material may be increased in a shielding region as compared to a configuration in which a shielding can is used, thereby improving properties of the coil component.

Also, in the coil component 1000 according to the exemplary embodiment, a size of the coil component may be significantly reduced while implementing an electrode structure in a lower portion. In other words, as an external electrode does not protrude from the both front and rear surfaces 101 and 102 or the both side surfaces 103 and 104 of the body, differently from the related art, an increase of a length and a width of the coil component 1000 caused by the insulating layer 600, the shielding layer 500, and the cover layer 700 may be partially alleviated. Also, as the external electrodes 300 and 400 have relatively reduced thicknesses, an overall thickness of the coil component 1000 may be reduced. Further, contact areas between the external electrodes 300 and 400 and the lead-out portions 231 and 232 may increase by the recesses R1 and R2 formed in the body 100, thereby improving reliability of components.

Secondary Embodiment

Figure 7:
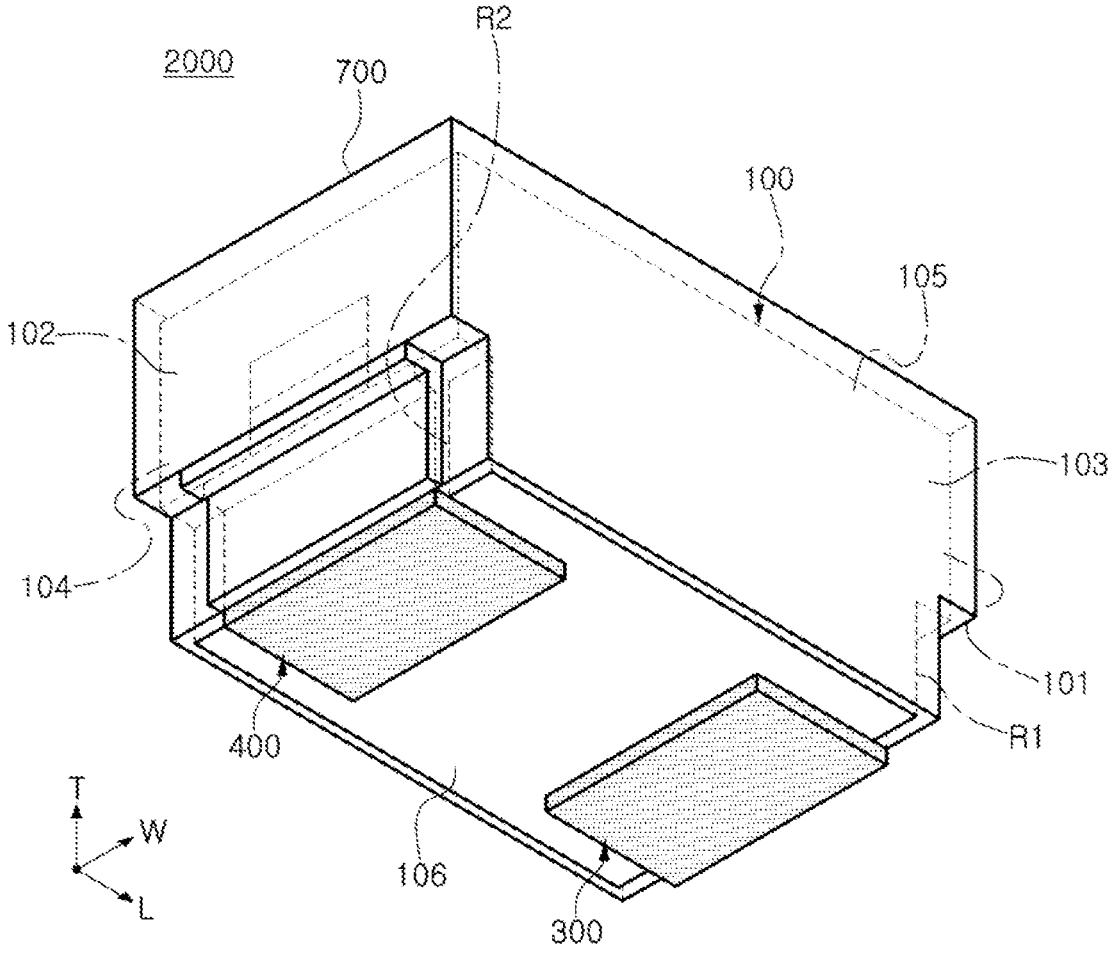
FIG. 7 is a schematic diagram illustrating a coil component according to another exemplary embodiment in the present disclosure.
Figure 8:
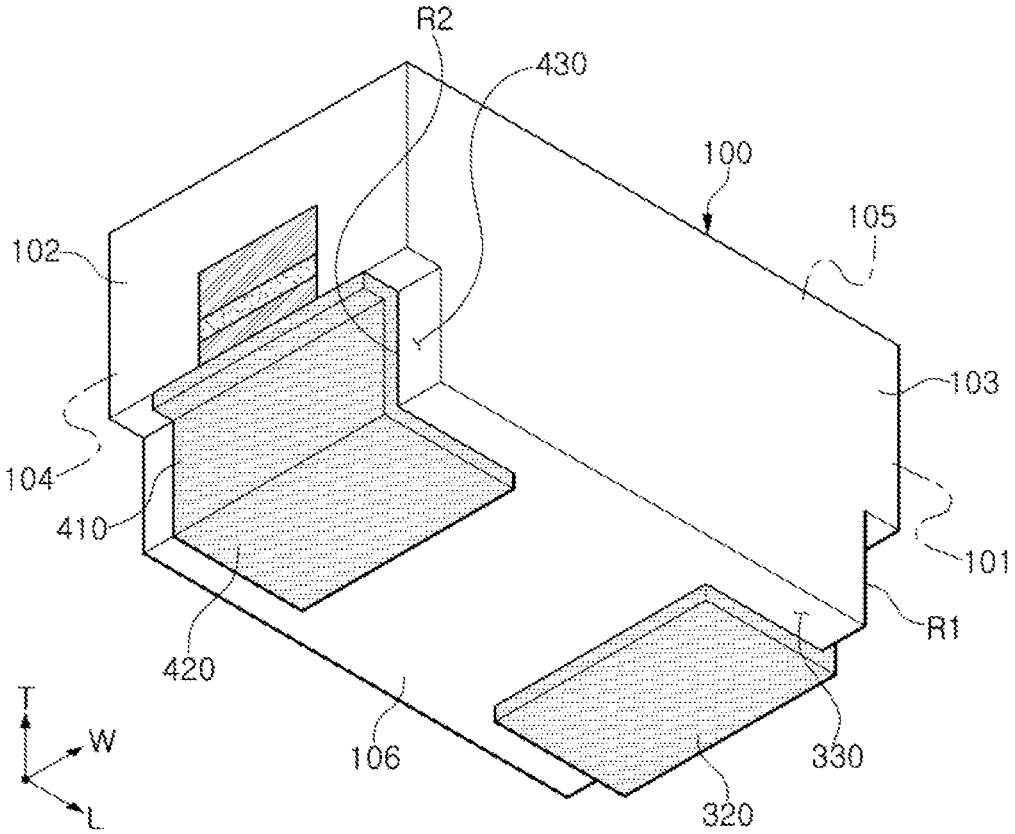
FIG. 8 is a diagram illustrating a coil component in which some of elements illustrated in FIG. 7 are omitted.

FIG. 7 is a schematic diagram illustrating a coil component according to another exemplary embodiment. FIG. 8 is a diagram illustrating a coil component in which some of elements illustrated in FIG. 7 are omitted, specifically illustrating a coil component in which an insulating layer, a shielding layer, and a cover layer are omitted.

Referring to FIGS. 1 to 8, in a coil component 2000 according to the exemplary embodiment, external electrodes 300 and 400 may be different from the external electrodes in the coil component 1000 in the aforementioned exemplary embodiment. Thus, in the exemplary embodiment, only the external electrodes 300 and 400 will be described, which are different from the external electrodes in the aforementioned exemplary embodiment.

The descriptions of the other elements in the exemplary embodiment will be the same as the descriptions in the aforementioned exemplary embodiment.

Referring to FIGS. 7 and 8, in the exemplary embodiment, the first and second external electrodes 300 and 400 may leave exposed: portions of recesses R1 and R2, namely 430; and portions of surface 106 of the body 100, namely 330. In other words, the first and second external electrodes 300 and 400 in the exemplary embodiment may not extend to boundaries between the recesses R1 and R2 and the third and fourth surfaces 103 and 104 of the body 100, or to boundaries between the sixth surface 106 of the body 100 and the third and fourth surfaces 103 and 104 of the body 100. The first and second external electrodes 300 and 400 in exemplary embodiment may not span the entire width of the recesses R1 and R2, respectively, nor span the entire width of surface 106 and the body 100.

According to the exemplary embodiment, a contact area between a coupling member such as a solder, and the like, used when the coil component 2000 is mounted on a printed circuit substrate, and the coil component 200 may increase. Accordingly, cohesion force between the coupling member and the coil component may improve. Also, in the exemplary embodiment, as the coupling member such as a solder, and the like, may be provided in exposing portions 310 and 410, thereby preventing the coupling member from extending up to the first and second surfaces 101 and 102.

Third Embodiment

Figure 9:
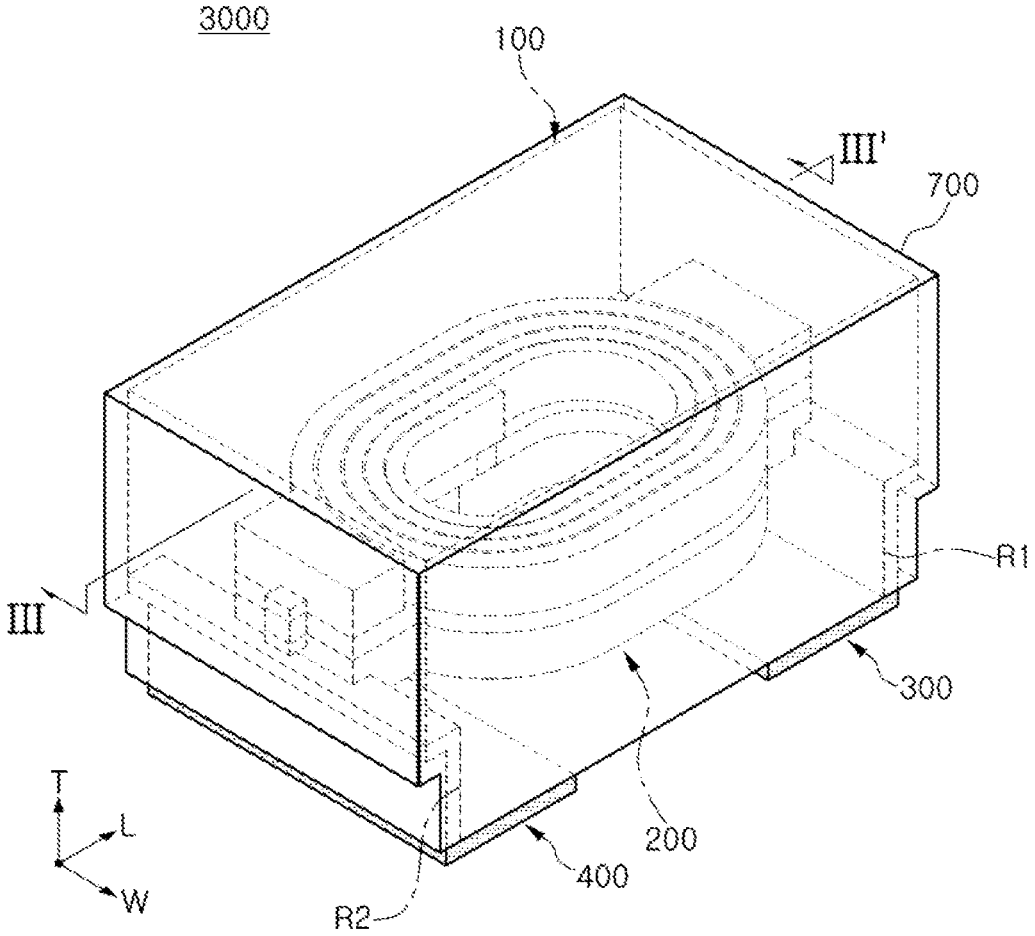
FIG. 9 is a schematic diagram illustrating a coil component according to another exemplary embodiment.
Figure 10:
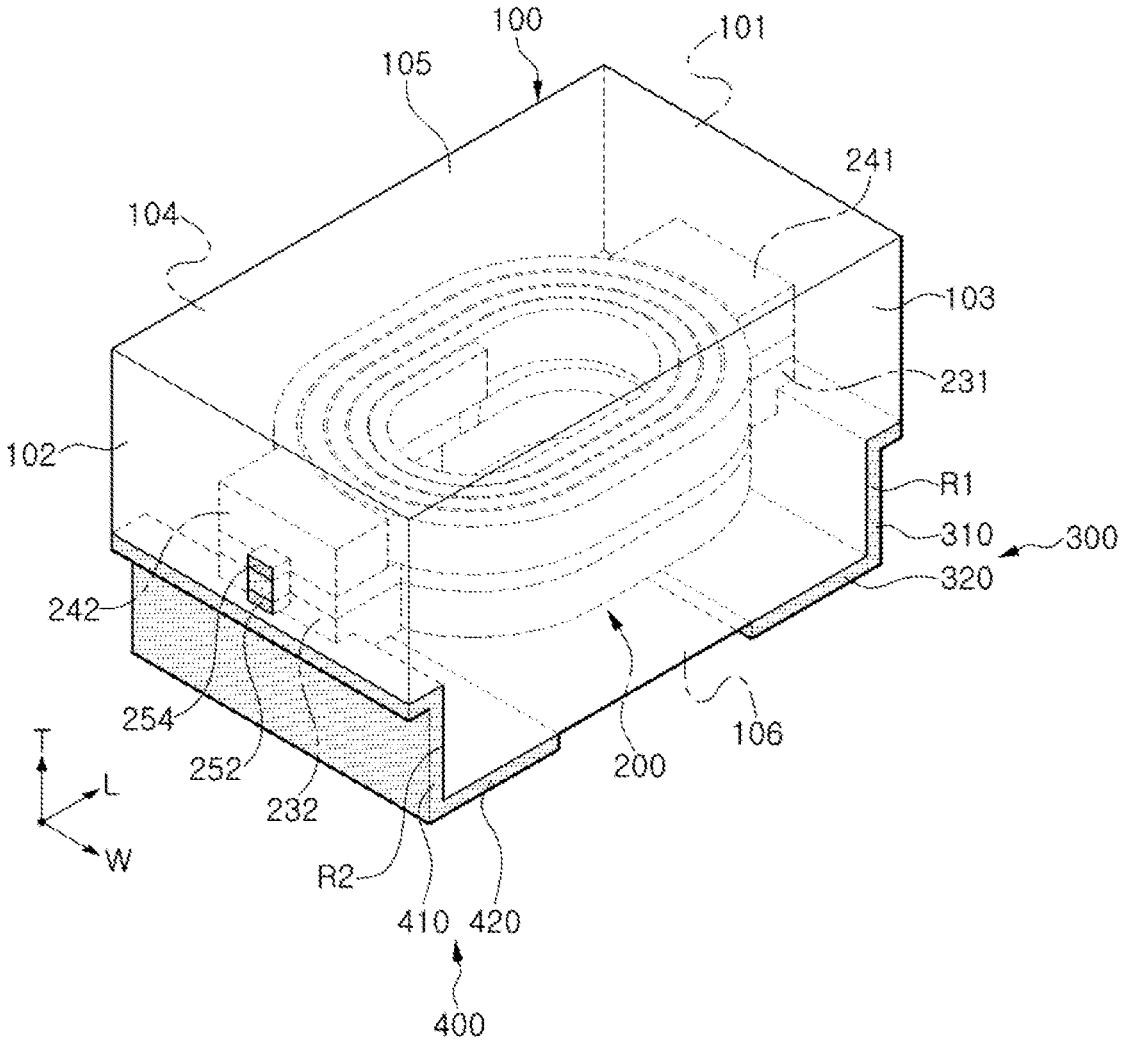
FIG. 10 is a diagram illustrating a coil component in which some of elements illustrated in FIG. 9 are omitted.
Figure 11:
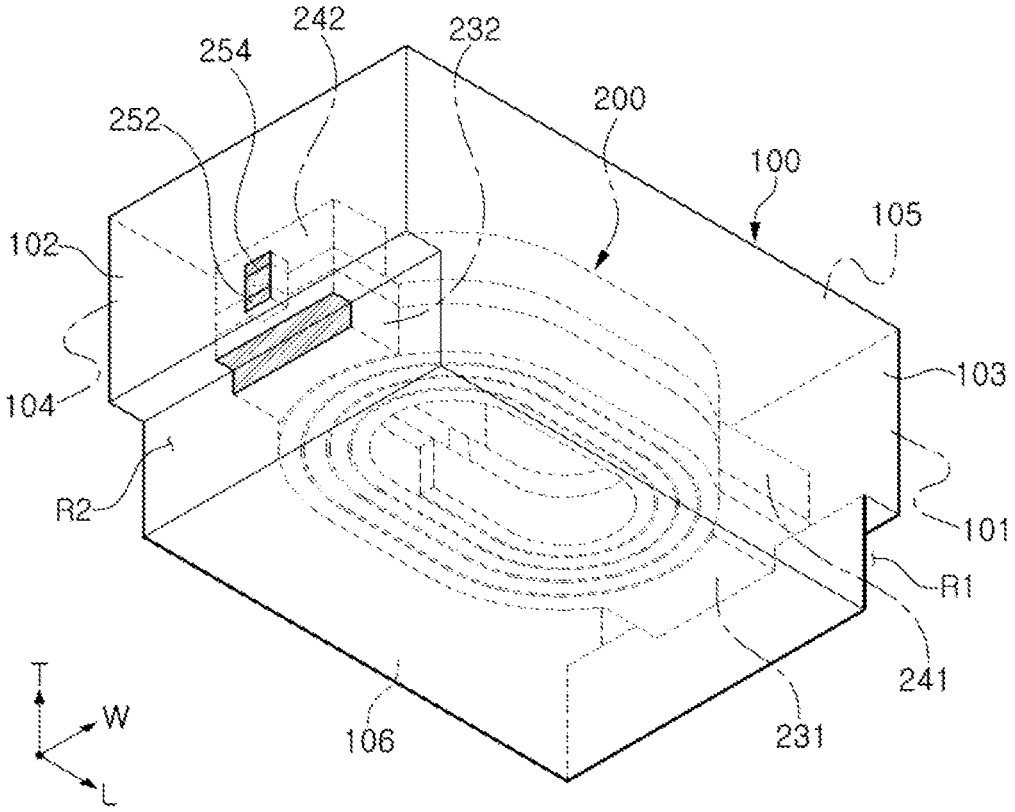
FIG. 11 is a cross-sectional diagram illustrating a coil component in which some of elements are omitted, viewing from a lower portion direction according to an exemplary embodiment in the present disclosure.
Figure 12:
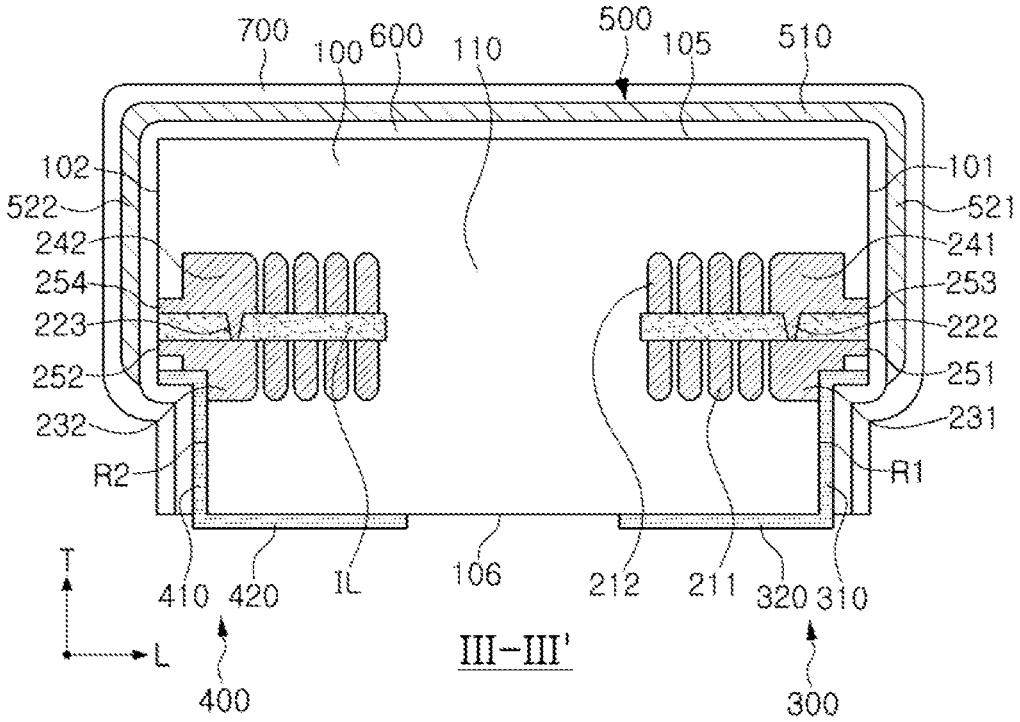
FIG. 12 is a cross-sectional diagram taken along line III-III' in FIG. 9.

FIG. 9 is a schematic diagram illustrating a coil component according to another exemplary embodiment. FIG. 10 is a diagram illustrating a coil component in which some of elements illustrated in FIG. 9 are omitted, specifically illustrating a coil component in which an insulating layer, a shielding layer, and a cover layer are omitted. FIG. 11 is a cross-sectional diagram illustrating a coil component in which some of elements are omitted, viewing from a lower portion direction according to an exemplary embodiment, specifically illustrating a coil component in which an insulating layer, a shielding layer, and a cover layer are omitted. FIG. 12 is a cross-sectional diagram taken along line III-III' in FIG. 9.

Referring to FIGS. 1 to 12, in a coil component 3000 according to an exemplary embodiment, a coil portion 200 is different from the coil portions in the coil components 1000 and 2000 in the aforementioned exemplary embodiments. Thus, in the exemplary embodiment, only the coil portion 200 will be described, which is different from the coil portions in the aforementioned exemplary embodiments. The descriptions of the other elements in the exemplary embodiment will be the same as the descriptions in the aforementioned exemplary embodiments.

The coil portion 200 in the exemplary embodiment may further include cohesion reinforcing portions 251, 252, 253, and 254 extending from lead-out portions 231 and 232, and auxiliary lead-out portions 241 and 242, and exposed to the first and second surfaces 101 and 102 of the body 100. For example, the coil portion 200 may further include a first cohesion reinforcing portion 251 extending from the first lead-out portion 231 and exposed to the first surface 101 of the body 100, a second cohesion reinforcing portion 252 extending from the second lead-out portion 232 and exposed to the second surface 102 of the body 100, a third cohesion reinforcing portion 253 extending from the first auxiliary lead-out portion 241 and exposed to the first surface 101 of the body 100, and a fourth cohesion reinforcing portion 254 extending from the second auxiliary lead-out portion 242 and exposed to the second surface 102 of the body 100. In the exemplary embodiment, differently from the aforementioned exemplary embodiment, the lead-out portions 231 and 232 and the auxiliary lead-out portions 241 and 242 may not be exposed to the first and second surfaces 101 and 102 of the body 100, and the cohesion reinforcing portions 251, 252, 253, and 254 extending from the lead-out portions 231 and 232 and the auxiliary lead-out portions 241 and 242 to both front and rear surfaces 101 and 102 of the body 100 may be exposed to the both front and rear surfaces 101 and 102 of the body 100.

The cohesion reinforcing portions 251, 252, 253, and 254 may have widths less than widths of the lead-out portions 231 and 232 and the auxiliary lead-out portions 241 and 242, or may have thicknesses smaller than thicknesses of the lead-out portions 231 and 232 and the auxiliary lead-out portions 241 and 242. In other words, the cohesion reinforcing portions 251, 252, 253, and 254 may reduce volumes of ends of the coil portion 200 such that an area of the coil portion 200 exposed to the first and second surfaces 101 and 102 of the body 100 may be significantly reduced.

Accordingly, the coil component 3000 according to the exemplary embodiment may improve cohesion force between the ends of the coil portion 200 and the body 100. In other words, by disposing the cohesion reinforcing portions 251, 252, 253, and 254 having volumes lower than volumes of the lead-out portions 231 and 232 and the auxiliary lead-out portions 241 and 242 in an outermost portion of the body 100, an effective area of the body 100 may improve in the outermost portion of the coil component 3000.

Further, in the coil component 3000, by improving a valid volume of a magnetic material, degradation of component properties may be prevented.

Also, in the coil component 3000, by reducing an area of the coil portion 200 exposed to both front and rear surfaces 101 and 102 of the body 100, and electrical shorts may be prevented.

In the exemplary embodiment, the cohesion reinforcing portions 251, 252, 253, and 254 may be formed as a plurality of cohesion reinforcing portions in the lead-out portions 231 and 232 and the auxiliary lead-out portions 241 and 242. For example, at least one of the first cohesion reinforcing portion 251 extending from the first lead-out portion 231 and exposed to the first surface 101 of the body 100, the second cohesion reinforcing portion 252 extending from the second lead-out portion 232 and exposed to the second surface 102 of the body 100, the third cohesion reinforcing portion 253 extending from the first auxiliary lead-out portion 241 and exposed to the first surface 101 of the body 100, and the fourth cohesion reinforcing portion 254 extending from the second auxiliary lead-out portion 242 and exposed to the second surface 102 of the body 100 maybe formed as a plurality of cohesion reinforcing portions.

Accordingly, in the coil component 3000 according to the exemplary embodiment, a contact area between the coil portion 200 and the body 100 may increase, thereby improving cohesion force between the coil portion 200 and the body 100.

Fourth Embodiment

Figure 13:
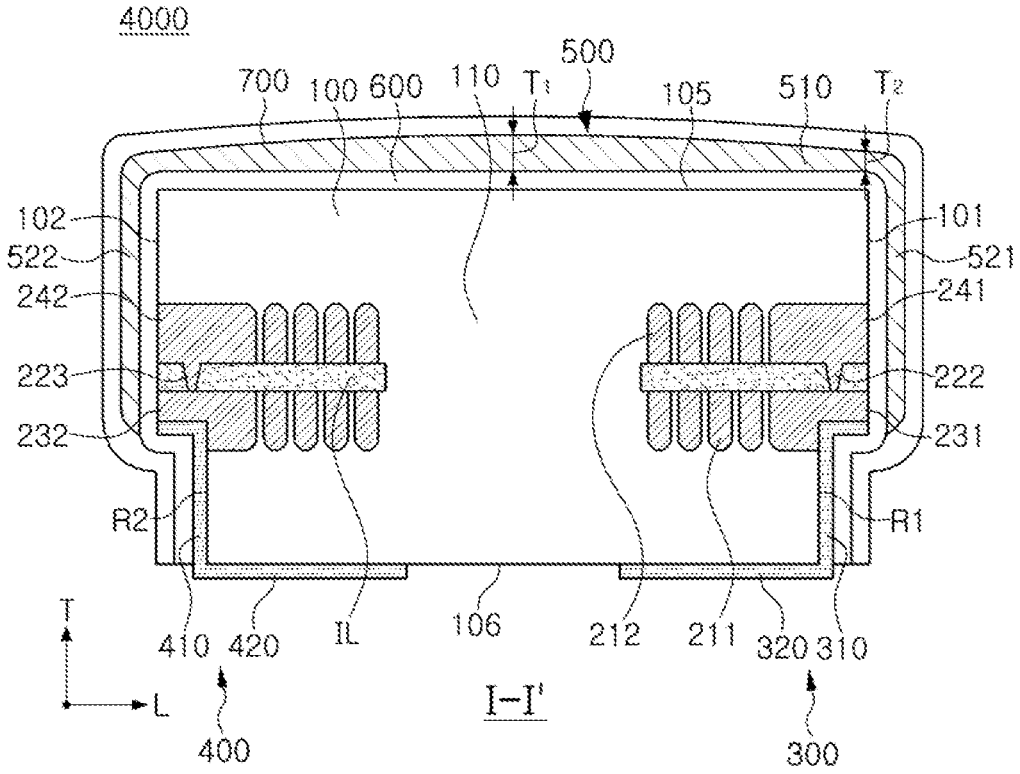
FIG. 13 is a cross-sectional diagram of a coil component corresponding to a cross-section taken in line I-I' in FIG. 1 according to another exemplary embodiment in the present disclosure.

FIG. 13 is a cross-sectional diagram of a coil component corresponding to a cross-section taken in line I-I' in FIG. 1 according to another exemplary embodiment.

Referring to FIGS. 1 to 13, in a coil component 4000 according to the exemplary embodiment, a cap portion 510 may be different from the cap portion in the coil components 1000, 2000, and 3000 in the aforementioned exemplary embodiments. Thus, in the exemplary embodiment, only the cap portion 510 will be described, which is different from the cap portion in the aforementioned exemplary embodiments. The descriptions of the other elements in the exemplary embodiment will be the same as the descriptions in the aforementioned exemplary embodiments.

Referring to FIG. 13, the cap portion 510 may be configured such that thickness T1 of a central portion is greater than thickness T2 of an outer portion. In the description below, the configuration above will be described in greater detail.

Coil patterns 211 and 212 of the coil portion 200 may form a plurality of turns formed from a central portion of an internal insulating layer IL to an outer portion of the internal insulating layer IL on each of both surfaces of the internal insulating layer IL, and the coil patterns 211 and 212 each may be layered in a thickness direction T of the body 100 and connected to each other by a via 221. Accordingly, in the coil component 4000, a magnetic flux density may be the highest at the central portion of a plane taken in a length direction L and a width direction W of the body 100, which are perpendicular to a thickness direction T of the body 100. Thus, in the exemplary embodiment, when the cap portion 510 disposed on the fifth surface of the body 100, which is substantially parallel to the plane taken in a length direction L and a width direction W of the body 100, is formed, the thickness T1 of a central portion of the cap portion 510 may be configured to be greater than the thickness T2 of an outer portion in consideration of a magnetic flux density distribution of the plane taken in a length direction L and a width direction W of the body 100.

Accordingly, in the coil component 4000 according to the exemplary embodiment, by forming thicknesses of the portions of the cap portion 510 differently in accordance with a magnetic flux density distribution, magnetic flux leakage may be reduced effectively.

Fifth Embodiment

Figure 14:
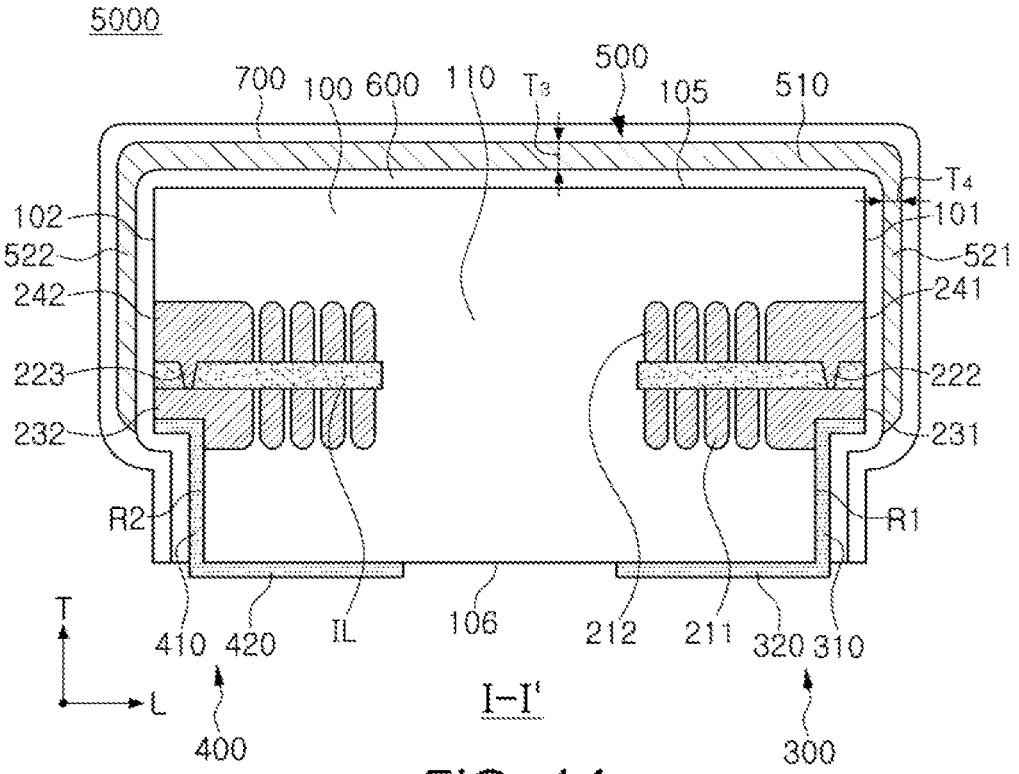
FIG. 14 is a cross-sectional diagram of a coil component corresponding to a cross-section taken in line I-I' in FIG. 1 according to another exemplary embodiment in the present disclosure.

FIG. 14 is a cross-sectional diagram of a coil component corresponding to a cross-section taken in line I-I' in FIG. 1 according to another exemplary embodiment.

Referring to FIGS. 1 to 14, in a coil component 5000 according to the exemplary embodiment, a cap portion 510 and side wall portions 521, 522, 523, and 524 may be different from the cap portion and the side wall portions in the coil components 1000, 2000, 3000, and 4000 in the aforementioned exemplary embodiments. Thus, in the exemplary embodiment, only the cap portion 510 and the side wall portions 521, 522, 523, and 524 will be described, which are different from the cap portion and the side wall portions in the aforementioned exemplary embodiments. The descriptions of the other elements in the exemplary embodiment will be the same as the descriptions in the aforementioned exemplary embodiments.

Referring to FIG. 14, thickness T3 of the cap portion 510 maybe greater than thicknesses T4 of the side wall portions 521, 522, 523, and 524.

As described above, a coil portion 200 may generate a magnetic field in a thickness direction T of the body 100. Accordingly, a magnetic flux leaking in a thickness direction T of the body 100 may be greater than a magnetic flux leaking in the other directions. Thus, a thickness of the cap portion 510 disposed on the fifth surface of the body 100, which is perpendicular to the thickness direction T of the body 100, may be configured to be greater than thicknesses of the side wall portions 521, 522, 523, and 524 disposed on walls of the body 100, thereby reducing magnetic flux leakage effectively.

As an example, a temporary shielding layer may be formed on first to fifth surfaces of the body 100 using a shielding sheet including an insulating film and a shielding film, and a shielding material may be additionally formed only on the fifth surface of the body 100, thereby forming a thickness of the cap portion 510 to be greater than thicknesses of the side wall portions 521, 522, 523, and 524. As another example, the body 100 may be disposed such that the fifth surface of the body 100 opposes a target, and a sputtering process for forming a shielding layer 500 may be performed, thereby forming a thickness of the cap portion 510 to be greater than thicknesses of the side wall portions 521, 522, 523, and 524. However, an exemplary embodiment thereof is not limited thereto.

Accordingly, in the coil component 5000 according to the exemplary embodiment, magnetic flux leakage maybe reduced effectively in consideration of a direction of a magnetic field formed by the coil portion 200.

Sixth Embodiment

Figure 15:
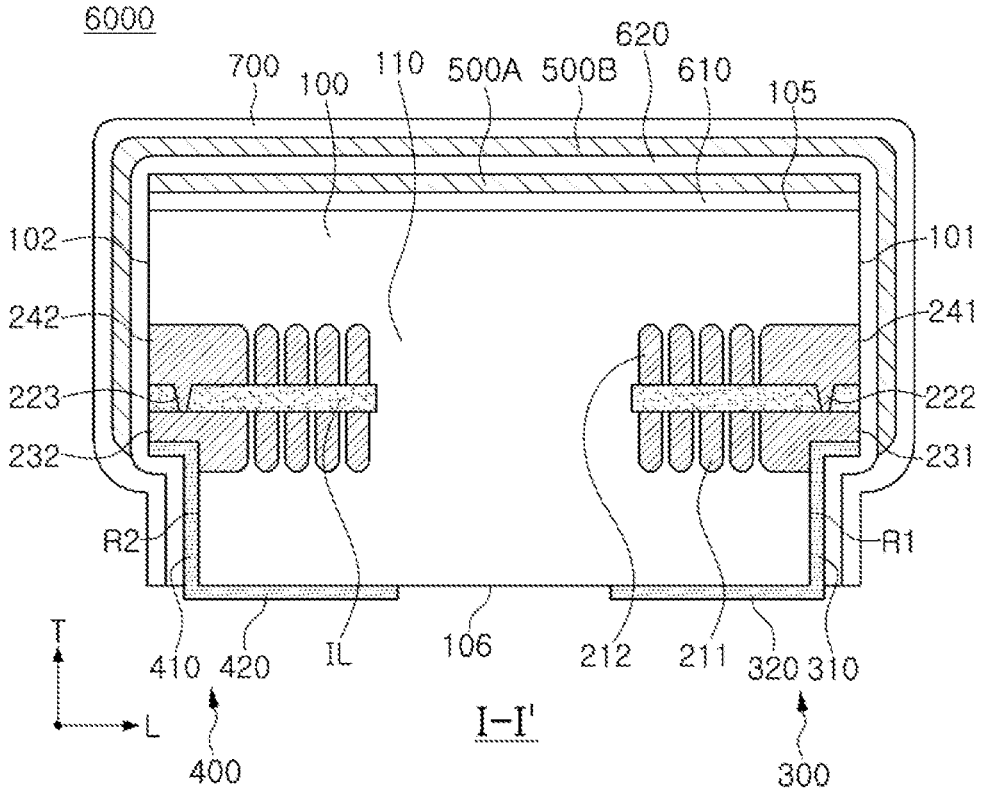
FIG. 15 is a cross-sectional diagram of a coil component corresponding to a cross-section taken in line I-I' in FIG. 1 according to another exemplary embodiment in the present disclosure.

FIG. 15 is a cross-sectional diagram of a coil component corresponding to a cross-section taken in line I-I' in FIG. 1 according to another exemplary embodiment.

Referring to FIGS. 1 to 15, in a coil component 6000 according to the exemplary embodiment, shielding layers 500A and 500B maybe different from the shielding layers in the coil components in the aforementioned exemplary embodiments. Thus, in the exemplary embodiment, only the shielding layers 500A and 500B will be described, which are different from the shielding layers in the aforementioned exemplary embodiments. The descriptions of the other elements in the exemplary embodiment will be the same as the descriptions in the aforementioned exemplary embodiments.

In the exemplary embodiment, the shielding layers 500A and 500B may be formed of a plurality of layers isolated from each other by an insulating layer 620. For example, the shielding layers 500A and 500B may include the first shielding layer 500A and the second shielding layer 500B isolated from each other by a second insulating layer 620.

The first shielding layer 500A may be disposed on the fifth surface of the body 100, which is the top surface of the body 100. A first insulating layer 610 may be disposed between the top surface of the body 100 and the first shielding layer 500A.

The first shielding layer 500A may include a magnetic material. For example, the first shielding layer 500A may include one or more materials selected from a group consisting of a ferrite, a permalloy, and an amorphous ribbon.

The second shielding layer 500B may be disposed on the first shielding layer 500A, and may be disposed on each of a plurality of walls of the body 100. In other words, the second shielding layer 500B may shield the fifth surface of the body 100.

The second shielding layer 500B may include a conductive material. For example, the second shielding layer 500B may be a metal or an alloy including one or more materials selected from a group consisting of copper (Cu), aluminum (Al), iron (Fe), silicon (Si), boron (B), chromium (Cr), niobium (Nb), and nickel (Ni), or may be Fe—Si or Fe—Ni.

The second insulating layer 620 may be disposed between the first shielding layer 500A and the second shielding layer 500B, and may extend onto lower ledge surfaces and internal walls of recesses R1 and R2 to cover connection portions 310 and 410. In other words, the second insulating layer 620 may cover the first to fifth surfaces 101, 102, 103, 104, and 105 of the body 100 and the connection portions 310 and 410 of external electrodes 300 and 400.

FIG. 15 illustrates the configuration in which the shielding layer including a magnetic material, the first shielding layer 500A, is disposed in an internal portion of the shielding layer 500B including a conductive material, but an exemplary embodiment thereof is not limited thereto. In other words, differently from the exemplary embodiment in FIG. 15, the shielding layer including a magnetic material may be disposed in an outer portion of the shielding layer including a conductive material.

In the exemplary embodiment, both of an absorption shielding effect by the first shielding layer 500A including a magnetic material and a reflective shielding effect by the second shielding layer 500B including a conductive material may be implemented. In other words, in a lower frequency band of 1 MHz or lower, magnetic flux leakage may be absorbed and shielded using the first shielding layer 500A, and in a high frequency band higher than 1 MHz, magnetic flux leakage may be reflected and shielded using the second shielding layer 500B. Thus, the coil component 6000 according to the exemplary embodiment may shield magnetic flux leakage in a relatively broad frequency band.

Seventh Embodiment

Figure 16:
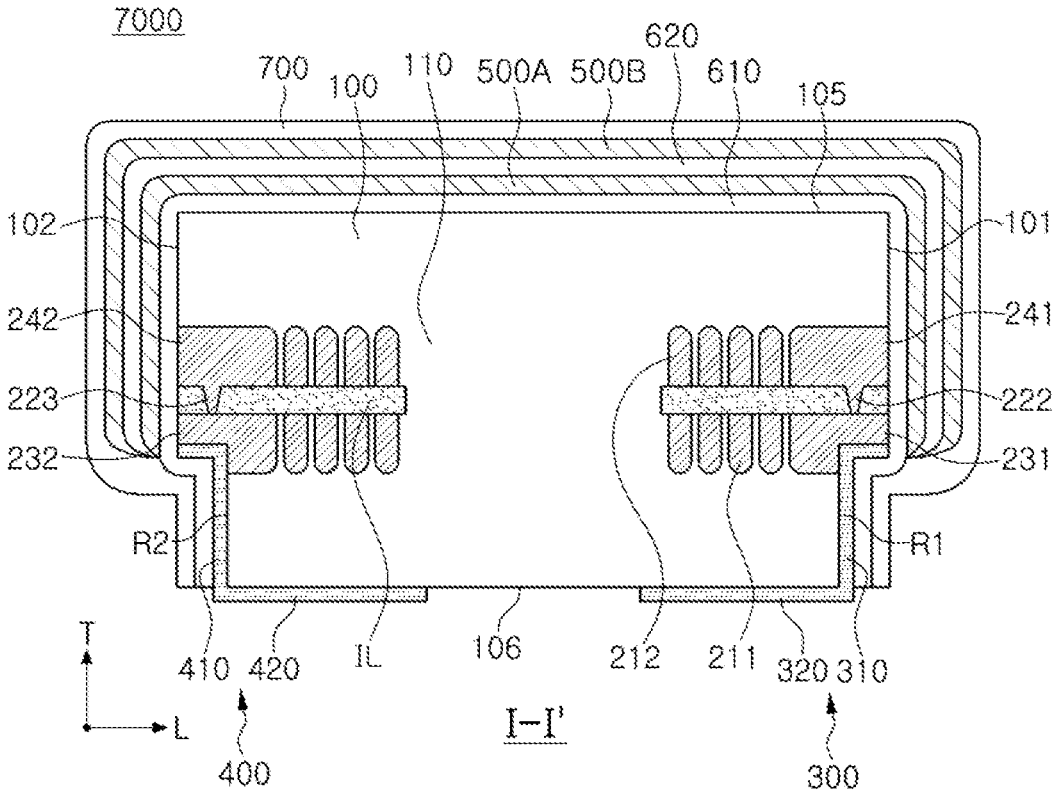
FIG. 16 is a cross-sectional diagram of a coil component corresponding to a cross-section taken in line I-I' in FIG. 1 according to another exemplary embodiment in the present disclosure.

FIG. 16 is a cross-sectional diagram of a coil component corresponding to a cross-section taken in line I-I' in FIG. 1 according to another exemplary embodiment.

Referring to FIGS. 1 to 16, in a coil component 7000 according to the exemplary embodiment, a shielding layer 500 may be configured differently from the shielding layers in the coil components 1000, 2000, 3000, 4000, 5000, and 6000 in the aforementioned exemplary embodiments. Thus, in the exemplary embodiment, only the shielding layer 500 will be described, which is different from the shielding layers in the aforementioned exemplary embodiments. The descriptions of the other elements in the exemplary embodiment will be the same as the descriptions in the aforementioned exemplary embodiments.

Referring to FIG. 16, the shielding layer 500 may be formed of a double layer structure.

In the exemplary embodiment, as the shielding layers 500A and 500B are formed of a double layer structure, magnetic flux leakage penetrating through the first shielding layer 500A disposed relatively adjacently to the body 100 may be shielded in the second shielding layer 500B relatively spaced apart from the body 100. Thus, in the coil component 7000, magnetic flux leakage may be shielded effectively.

Also, in the exemplary embodiment, the shielding layers 500A and 500B may be formed on each of the first to fifth surfaces of the body 100. In other words, the double-layered shielding layers may be formed across the fifth surface of the body.

It may be desirable to form the first and second shielding layers 500A and 500B using a conductive material, but an exemplary embodiment thereof is not limited thereto.

Also, in the exemplary embodiment, insulating layers 610 and 620 may also be formed as a plurality of insulating layers. The first insulating layer 610 may be formed between the body 100 and the first shielding layer 500A and may extend onto the connection portions 310 and 320, and the second shielding layer 500B may be formed between the first shielding layer 500A and the second shielding layer 500B and may extend onto the connection portions 310 and 320.

The second insulating layer 620 formed between the first shielding layer 500A and the second shielding layer 500B may function as a wave guide for noise reflected from the second shielding layer 500B.

According to the aforementioned exemplary embodiments, magnetic flux leakage may be reduced.

Also, according to the aforementioned exemplary embodiments, magnetic flux leakage may be reduced while reducing a size and a thickness of a coil component.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having a bottom surface and a top surface opposing each other in one direction, and a plurality of walls each connecting the bottom surface to the top surface of the body;

recesses respectively formed in both front and rear surfaces of the body opposing each other among the plurality of walls of the body and extending to the bottom surface of the body, wherein the recesses include internal walls and lower ledge surfaces;

a coil portion buried in the body and including first and second lead-out portions exposed from the internal walls and lower ledge surfaces;

first and second external electrodes respectively including connection portions disposed in the recesses and extended portions disposed on the bottom surface of the body, respectively, and connected to the coil portion;

a shielding layer including a cap portion disposed on the top surface of the body and side wall portions respectively disposed on the plurality of walls of the body; and an insulating layer disposed between the body and the shielding layer and extending onto the lower ledge surfaces and the internal walls to cover the connection portions.

2. The coil component of claim 1, wherein the connection portions and the extended portions are formed along the lower ledge surfaces of the recesses, internal walls of the recesses, and the bottom surface of the body in integrated form.

3. The coil component of claim 1, wherein the recesses extend up to both side surfaces of the body which connect both front and rear surfaces of the body among the plurality of walls of the body.

4. The coil component of claim 3, wherein the first and second external electrodes respectively expose boundaries between both side surfaces of the body and the internal walls of the recesses, and boundaries between both side surfaces of the body and the bottom surface of the body, and do not span an entire width of the internal walls of the recesses nor span entire width of the bottom surface of the body.

5. The coil component of claim 1, wherein one surfaces of the first and second lead-out portions exposed to the recesses have surface roughness higher than surface roughness of surfaces of the first and second lead-out portions other than the one surfaces of the first and second lead-out portions.

6. The coil component of claim 1, further comprising:

an internal insulating layer buried in the body to support the coil portion, wherein the first and second lead-out portions are disposed on one surface of the internal insulating layer opposing one surface of the body and are spaced apart from each other, and wherein the coil portion comprises:

a first coil pattern disposed on one surface of the internal insulating layer to be in contact with the first lead-out portion and to be spaced apart from the second lead-out portion;

a second coil pattern disposed on the other surface of the internal insulating layer opposing one surface of the internal insulating layer; and a via penetrating through the internal insulating layer to connect the first coil pattern to the second coil pattern.

7. The coil component of claim 6, wherein the coil portion further comprises cohesion reinforcing portions respectively extending from the first and second lead-out portions and respectively exposed from both front and rear surfaces of the body.

8. The coil component of claim 7, wherein the cohesion reinforcing portions have thicknesses smaller than thicknesses of the first and second lead-out portions.

9. The coil component of claim 8, wherein the cohesion reinforcing portions have widths less than widths of the first and second lead-out portions.

10. The coil component of claim 1, wherein the cap portion is configured such that a thickness of a central portion of the top surface of the body is greater than a thickness of an outer portion of the top surface of the body.

11. The coil component of claim 1, wherein the cap portion has a thickness greater than thicknesses of the side wall portions.

12. The coil component of claim 1, wherein the shielding layer includes at least one of a conductive material or a magnetic material.

13. The coil component of claim 1, wherein the shielding layer includes a first shielding layer including a magnetic material, and a second shielding layer disposed on the first shielding layer and including a conductive material, and wherein the insulating layer includes a first insulating layer disposed between the first shielding layer and the body, and a second insulating layer disposed between the first shielding layer and the second shielding layer.

14. A coil component, comprising:

a body including a magnetic metal powder;

a coil portion including lead-out portions and buried in the body;

recesses formed on side surfaces of the body and exposing the lead-out portions from internal walls and lower ledge surfaces of the recesses;

external electrodes formed on the internal walls and lower ledge surfaces and connected to the coil portion;

a shielding layer disposed on a surface of the body other than the lower ledge surfaces and internal walls; and an insulating layer disposed between the body and the shielding layer, wherein the external electrodes are formed along the internal walls and lower ledge surfaces, and wherein the insulating layer is formed to extend onto at least portions of the external electrodes.

15. The coil component of claim 1, further comprising a cover layer disposed on the shielding layer to cover the shielding layer and contacted with the insulating layer.

16. The coil component of claim 15, wherein a sum of thicknesses of the insulating layer, the shielding layer, and the cover layer is greater than 30 nm and 100 μm or lower.

* * * * *